US008631534B2

(12) United States Patent
Blanchard et al.

(10) Patent No.: US 8,631,534 B2
(45) Date of Patent: Jan. 21, 2014

(54) TOOTHBRUSH

(75) Inventors: Stephen John Blanchard, Princeton, NJ (US); Bethann O'Malley, Hillsborough, NJ (US); Justin McDonough, Flemington, NJ (US)

(73) Assignee: Dr. Fresh, LLC, Buena Park, CA (US)

( * ) Notice: Subject to any disclaimer, the term of this patent is extended or adjusted under 35 U.S.C. 154(b) by 1834 days.

(21) Appl. No.: 11/423,067

(22) Filed: Jun. 8, 2006

(65) Prior Publication Data

US 2007/0283518 A1 Dec. 13, 2007

(51) Int. Cl.
*A46B 9/04* (2006.01)

(52) U.S. Cl.
USPC ..... 15/110; 15/167.1; 15/188

(58) Field of Classification Search
CPC ..... A46B 9/04; A45B 9/06
USPC ..... 15/167.1, 110, 139, 141; D4/104, 108
See application file for complete search history.

(56) References Cited

U.S. PATENT DOCUMENTS

| | | | | |
|---|---|---|---|---|
| 1,567,507 | A | 12/1925 | Howard | |
| 1,570,388 | A | 1/1926 | Miller | |
| 1,588,785 | A * | 6/1926 | Van Sant | 15/110 |
| 1,901,646 | A | 3/1933 | Hicks | |
| 1,924,152 | A * | 8/1933 | Coney et al. | 15/167.1 |
| 2,088,839 | A * | 8/1937 | Coney et al. | 15/167.1 |
| 2,242,743 | A * | 5/1941 | Brown | 15/167.1 |
| 2,429,740 | A * | 10/1947 | Aufsesser | 15/167.1 |
| 4,081,876 | A | 4/1978 | Pugh | |
| 4,268,933 | A | 5/1981 | Papas | |
| 4,277,862 | A * | 7/1981 | Weideman | 15/110 |
| 4,373,541 | A | 2/1983 | Nishioka | |
| 4,520,526 | A | 6/1985 | Peters | |
| 4,646,381 | A | 3/1987 | Weihrauch | |
| 4,780,924 | A | 11/1988 | Hansen et al. | |
| 4,852,202 | A | 8/1989 | Ledwitz | |
| 5,054,154 | A | 10/1991 | Schiffer et al. | |
| 5,137,039 | A | 8/1992 | Klinkhammer | |
| 5,146,645 | A | 9/1992 | Dirksing | |
| D334,288 | S | 3/1993 | Witzing-Jaggi | |
| D345,054 | S * | 3/1994 | Spence, Jr. | D4/104 |
| 5,398,368 | A * | 3/1995 | Elder | 15/167.1 |
| 5,398,369 | A | 3/1995 | Heinzelman et al. | |

(Continued)

FOREIGN PATENT DOCUMENTS

| | | |
|---|---|---|
| EP | 0663162 A1 | 7/1995 |
| EP | 1 221 962 B9 | 6/2000 |

(Continued)

OTHER PUBLICATIONS

US 5,105,459, 04/21/1992, Dirksing (withdrawn).

*Primary Examiner* — Monica Carter
*Assistant Examiner* — Michael Jennings
(74) *Attorney, Agent, or Firm* — Snell & Wilmer LLP

(57) ABSTRACT

The invention includes a toothbrush including a toothbrush handle and a toothbrush head having an end proximal a toothbrush handle, an end distal to the toothbrush handle, a dorsal surface for holding at least one toothbrush bristle, a ventral surface opposite the dorsal surface, first and second sides disposed between the dorsal and ventral surfaces of the toothbrush head, and a plurality of gum cushions disposed on each of the sides of the toothbrush head, where the height of the respective gum cushions tapers from the proximal end of the toothbrush head to the distal end of the toothbrush head.

23 Claims, 3 Drawing Sheets

(56) References Cited

U.S. PATENT DOCUMENTS

| | | | | |
|---|---|---|---|---|
| 5,446,940 | A * | 9/1995 | Curtis et al. | 15/167.1 |
| D368,163 | S | 3/1996 | Overthun | |
| D368,803 | S | 4/1996 | Yost et al. | |
| 5,511,275 | A | 4/1996 | Volpenhein et al. | |
| D372,584 | S * | 8/1996 | Yost et al. | D4/104 |
| D374,350 | S | 10/1996 | Yost et al. | |
| D376,695 | S | 12/1996 | Tveras | |
| 5,628,082 | A * | 5/1997 | Moskovich | 15/110 |
| D383,608 | S | 9/1997 | Yamamoto et al. | |
| D387,205 | S | 12/1997 | Moskovich | |
| 5,799,353 | A | 9/1998 | Oishi et al. | |
| 5,802,656 | A | 9/1998 | Dawson et al. | |
| D402,116 | S | 12/1998 | Magloff et al. | |
| D402,471 | S | 12/1998 | Magloff et al. | |
| D420,802 | S * | 2/2000 | Cheong et al. | D4/104 |
| D424,808 | S | 5/2000 | Beals et al. | |
| 6,151,745 | A | 11/2000 | Roberts et al. | |
| D437,688 | S | 2/2001 | Beals et al. | |
| D443,985 | S | 6/2001 | Beals et al. | |
| D445,571 | S * | 7/2001 | Harada | D4/104 |
| 6,272,714 | B2 | 8/2001 | Beals | |
| 6,292,973 | B1 | 9/2001 | Moskovich et al. | |
| 6,308,367 | B1 | 10/2001 | Beals et al. | |
| D451,284 | S | 12/2001 | Moskovich et al. | |
| 6,352,313 | B1 | 3/2002 | Wilson et al. | |
| 6,361,120 | B1 | 3/2002 | Szczech et al. | |
| 6,405,401 | B1 | 6/2002 | Hellerud et al. | |
| D462,525 | S | 9/2002 | Grau et al. | |
| D463,131 | S | 9/2002 | Winter et al. | |
| 6,463,618 | B1 * | 10/2002 | Zimmer | 15/110 |
| 6,496,999 | B1 | 12/2002 | Gleason et al. | |
| D475,200 | S | 6/2003 | Grossman et al. | |
| D475,532 | S | 6/2003 | Crossman et al. | |
| 6,599,048 | B2 * | 7/2003 | Kuo | 401/269 |
| D479,404 | S | 9/2003 | Grau et al. | |
| D486,649 | S | 2/2004 | Sprosta et al. | |
| 6,938,293 | B2 * | 9/2005 | Eliav et al. | 15/22.1 |
| 6,966,093 | B2 * | 11/2005 | Eliav et al. | 15/22.1 |
| 7,162,767 | B2 * | 1/2007 | Pfenniger et al. | 15/167.1 |
| D563,106 | S * | 3/2008 | Chan et al. | D4/101 |
| 7,360,270 | B2 * | 4/2008 | Moskovich et al. | 15/28 |
| 7,386,905 | B2 * | 6/2008 | Eliav et al. | 15/22.1 |
| 7,549,187 | B2 * | 6/2009 | Pfenniger et al. | 15/167.1 |
| 8,276,233 | B2 * | 10/2012 | Gavney et al. | 15/117 |
| 2003/0077107 | A1 | 4/2003 | Kuo | |
| 2003/0196283 | A1 * | 10/2003 | Eliav et al. | 15/22.1 |
| 2004/0117934 | A1 * | 6/2004 | Pfenniger et al. | 15/167.1 |
| 2005/0011031 | A1 | 1/2005 | Ansari et al. | |
| 2005/0036821 | A1 | 2/2005 | Pfenniger et al. | |
| 2005/0039279 | A1 | 2/2005 | Koeth et al. | |
| 2005/0091773 | A1 * | 5/2005 | Gavney et al. | 15/117 |
| 2006/0000037 | A1 * | 1/2006 | Eliav et al. | 15/22.1 |

FOREIGN PATENT DOCUMENTS

| | | | |
|---|---|---|---|
| EP | 0885573 | B2 | 5/2005 |
| GB | 440630 | | 1/1936 |
| GB | 2297478 | A | 2/1995 |
| WO | WO 88/06417 | A1 | 9/1988 |
| WO | WO 89/10076 | A1 | 11/1989 |
| WO | WO 94/09677 | A1 | 5/1994 |
| WO | WO 95/06420 | A1 | 3/1995 |
| WO | WO 96/09781 | A1 | 4/1996 |
| WO | WO 98/18364 | A1 | 5/1998 |
| WO | WO 99/23910 | A | 5/1999 |
| WO | WO 00/25631 | A1 | 5/2000 |
| WO | WO 00/65953 | A1 | 11/2000 |
| WO | WO 00/74523 | A1 | 12/2000 |
| WO | WO 01/17391 | A1 | 3/2001 |
| WO | WO 01/17392 | A1 | 3/2001 |
| WO | WO 01/43584 | A1 | 6/2001 |
| WO | WO 2004/064573 | A1 | 8/2004 |

* cited by examiner

TOOTHBRUSH

FIELD OF THE INVENTION

This patent relates to a toothbrush that is comfortable to use and that provides the user of the toothbrush with an indication of when the user may be brushing with excess pressure.

BACKGROUND OF THE INVENTION

A toothbrush sold under the Tradename Mentadent White & Clean has a handle that includes a base, an offset, a straight neck, and an angled toothbrush head. A toothbrush also is known which includes a base, a thumb grip portion, an offset, a neck and a head, where the offset and neck are angled with respect to the longitudinal axis of the base. However, such brushes do not indicate to the consumer when one may be using excessive force during brushing. There is a continuing need for a toothbrush handle that is more comfortable during use, that optionally provides improved access to back teeth, and that serves to indicate when one may wish to brush softer. The present invention provides such a benefit.

SUMMARY OF THE INVENTION

The present invention provides a toothbrush including a toothbrush handle and toothbrush head having an end proximal the toothbrush handle, an end distal to the toothbrush handle, a dorsal surface for holding at least one toothbrush bristle, a ventral surface opposite the dorsal surface, first and second sides disposed between the dorsal and ventral surfaces of the toothbrush head, and a plurality of gum cushions disposed on each of the sides of the toothbrush head, where the height of the respective gum cushions tapers from the proximal end of the toothbrush head to the distal end of the toothbrush head.

DETAILED DESCRIPTION OF THE IVENTION

Figure 6:
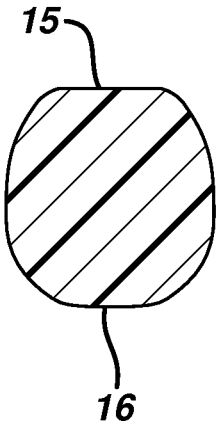
FIG. 6 is a cross-section through the base portion of the toothbrush at A-A.

As is seen in FIGS. 1-7, where like numbers refer to like elements, in one embodiment, a toothbrush 20 of the present invention has a base portion 1, having a dorsal surface 15, a ventral surface 16 and longitudinal axis b bisecting base portion 1. Base portion 1 is ovoid and is sized to fit comfortably in the palm of a consumer's hand. As used herein, ovoid means a two-dimensional figure where the cross-section of the figure is generally rounded and includes ovoidal shapes having one or both of the top and bottom surfaces flattened of the figures flattened, as seen in FIG. 6. Base portion 1 tapers towards a brush head 6 to form a waist 2. A grip portion 7 is adjacent waist 2 and terminates at a shoulder 3 . An offset 4 is disposed between shoulder 3 and a neck 5, which is adjacent to toothbrush head 6. Toothbrush head 6 has a dorsal surface 13 that is continuous with dorsal surface 15 of the toothbrush. Grip portion 7 and waist 2 are concave with respect to dorsal surface 15 of the toothbrush . Offset 4 is designed to provide improved access to back teeth. The angle c' of the longitudinal axis c bisecting offset 4, with respect to longitudinal axis b bisecting base portion 1, may range from about 10 to about 45 degrees, or about 20 to about 30 degrees, for example 24 degrees. The angle a' of the longitudinal axis a bisecting toothbrush neck 5, with respect to the longitudinal axis b of base portion 1, may range from about 5 to about 15 degrees, or from about 10 to about 15 degrees, for example 12 degrees. Toothbrush head 6 is sized for maximum cleaning and comfort during use. Ventral surface 16 of base portion 1 and the point where offset 4 and neck 5 meet may be flatened to prevent the toothbrush from rolling when placed on a flat surface, e.g. a counter top. In addition, dorsal surface 15 of base portion 1 may be flattened to provide a more comfortable grip in the hand, provided that the general ovoidal configuration, as defined herein above, is maintained.

Toothbrush head 6 of the present invention comprises dorsal surface 13 for containing at least one bristle, a ventral surface 14 opposite dorsal surface 13, and first 17 and second 18 sides disposed between dorsal 13 and ventral 14 sides of head 6. Each of the first and second sides comprise an equal number of gum cushions 8 attached thereto. Gum cushions 8 located on either side may be of the same configuration and size, although embodiments where slight differences in configuration and size are included within the scope of the invention. The gum cushions may be made from any soft and flexible material, for example thermoset or thermoplastic elastomers, such as silicone, ethylene propylene diene monomer, styrene copolymers, or rubber. The gum cushions are designed to serve as an indicator of when a consumer is brushing with too much force, which may lead to discomfort or damage to the gums. In this case, the consumer feels the cushions contacting their gums and knows that they should brush with less force. The number of cushions will depend on the size of the toothbrush head. In a fill size toothbrush head, for example one used by adults, the number of gum cushions on each side of the brush head may range from 2 to 5, for example 3. In a compact toothbrush head, for example one used by children or adults with smaller jaws, the number of gum cushions on each side may range from 1 to 3, for example 2. The gum cushions may be separate one from the other, or they may be molded in an integral configuration providing multilobal cushions on both sides of the brush head.

Figure 7:
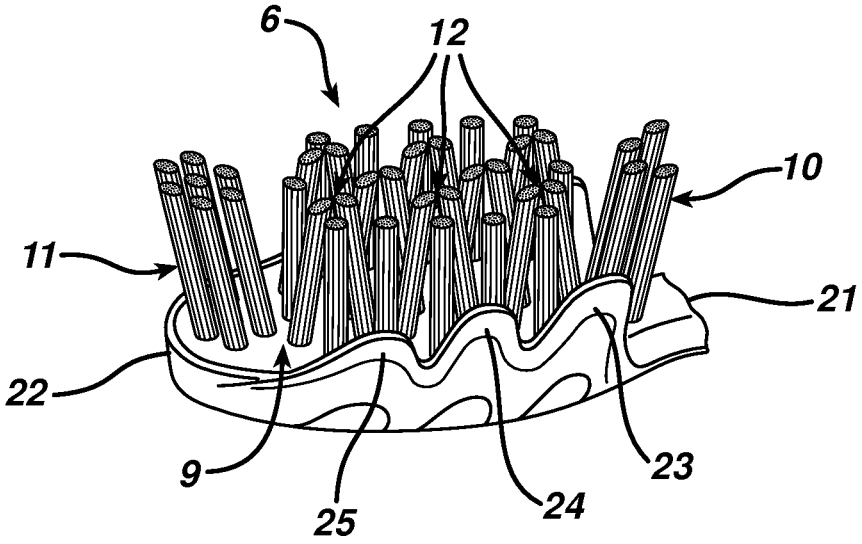
FIG. 7 is an elevated side view of a toothbrush head according to the present invention.

The gum cushions are sized to function as indicators of brushing pressure, or force. The height of the gum cusions should be less than the height of the bristles so that the cushion is not in contact with the gums while appropriate brushing pressure is being applied. Thus, the height of the cushions relative to the height of the bristles is such that contact with the gums by the cushions may be made at the appropriate pressure, thus indicating that the force being applied is sufficient, while still exposing the teeth to a sufficient bristle area to provide for cleaning of teeth. For instance, the height of the cushions from the dorsal surface of the brush head may range from about 3 to about 9 mm, for example 5, or 7, or 8 mm. In one embodiment as shown in FIG. 7, the toothbrush head contains 3 gum cushions on each side of the brush head that taper in height from the end 21 of the toothbrush head that is proximal to the base portion of the toothbrush to the end 22 of the toothbrush head that is distal to the base of the handle. In this embodiment, the height of the gum cushion 23 proximal to the base portion of the toothbrush handle may be about 8 mm, the height of the middle gum cushion 24 may be about 6.5 mm, and the height of the gum cushion 25 distal to the base portion may be about 5 mm. In order to enable better access to the back teeth, there is a gap 9 between gum cushion 25 and distal end 22 of the toothbrush head. The size of the gap may range from about 5 mm to about 9 mm, for example about 6.5 mm, or about 7.5 mm.

While the embodiments discussed above and exemplified in the figures utilize the toothbrush head containing gum cushions in combination with toothbrush handles comprising angled offset and neck portions, other embodiments of the invention may utilized the inventive toothbrush heads with toothbrush handles that do not include angled offset and/or neck portions.

The toothbrush may be made of plastics such as, but not limited to, cellulose acetate propionate, nylon, polyethylene, polypropylene, polycarbonate, and poly(ethylene terephthalate). The plastic is heated above its melting point and injected into a toothbrush cavity in a toothbrush mold.

The toothbrush may be finished by conventional techniques to add bristles to the head of the toothbrush The bristles may be stapled into the head of the toothbrush or fused onto the head of the toothbrush. The handle of the toothbrush may be overmolded with materials such as thermoplastic or thermoset elastomers, such as silicone, ethylene propylene diene monomer, styrene copolymers, or rubber. The overmolding process may be carried out in the original toothbrush mold. Alternatively, the toothbrush may be transferred to a separate mold for the overmolding process. The overmolding may be thicker in the thumb grip portion to provide increased comfort during use. Different elastomeric materials may be overmolded in different regions of the toothbrush handle to provide a different feel or different functions.

The toothbrush head contains toothbrush bristles for cleaning the teeth. The toothbrush bristles may be made from any conventional toothbrush bristle material such as nylon, polyamides, polyesters, polybutylene terephthalate, polypropylene, acetal resins, fluoropolymers, polyacrylates, and polysulfones. The toothbrush bristles may be structured, flocked or coated on their surface area. The toothbrush bristles may contain additives such as, but not limited to abrasives and polishing agents; anti-cavity agents such as sodium fluoride; antimicrobial agents, and combinations thereof. The toothbrush bristles may be angled. For example, as seen in FIG. 7, the toothbrush bristles that make up the heel tuft 10, may be at an angle of less than 90 degrees, for example from about 75 to about 85 degrees, or about 83 degrees, towards the base of the toothbrush handle and the toothbrush bristles that make up the toe tuft 11, may be at an angle of less than 90 degrees, for example from about 75 to about 85 degrees, or about 83 degrees, towards the distal end of the toothbrush head. The center portion of the toothbrush head may contain rows of toothbrush bristles in pairs of tufts 12 that are angled towards each other along the longitudinal direction of the toothbrush head. The angle of these toothbrush bristle tufts may also be about 83 degrees. The top of each tuft may be trimmed in the same direction as the angle of the tuft, optionally at the same angle as the angle of the tuft, forming angled peaks.

Several examples are set forth below to further illustrate the nature certain embodiments of the invention and the manner of carrying it out. However, the invention should not be considered as being limited to the details thereof.

EXAMPLES

Example 1

Toothbrush Handle

Figure 1:
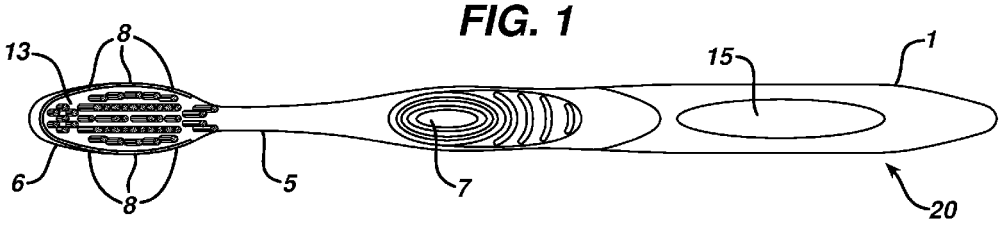
FIG. 1 is a top plan view of a toothbrush according to the present invention.
Figure 2:
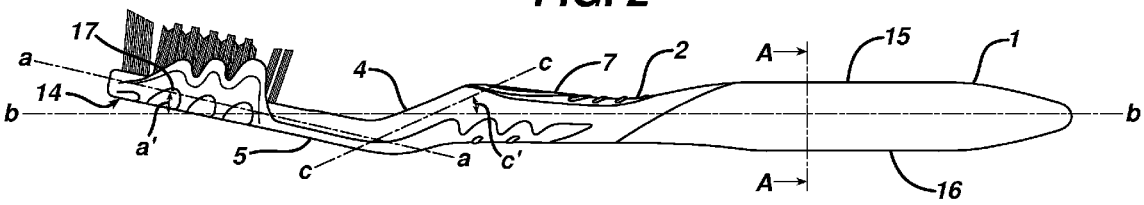
FIG. 2 is a side view of the toothbrush of FIG. 1.
Figure 3:
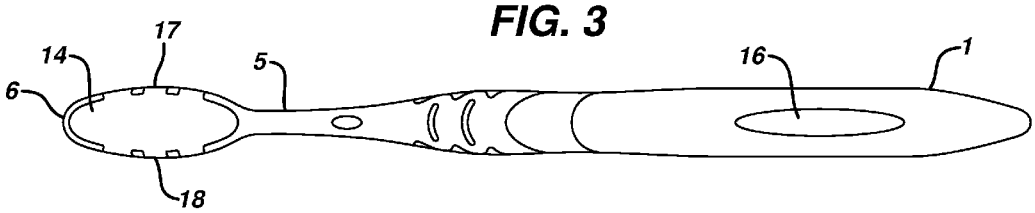
FIG. 3 is a plan view of the bottom side of the toothbrush of FIG. 1.
Figure 4:
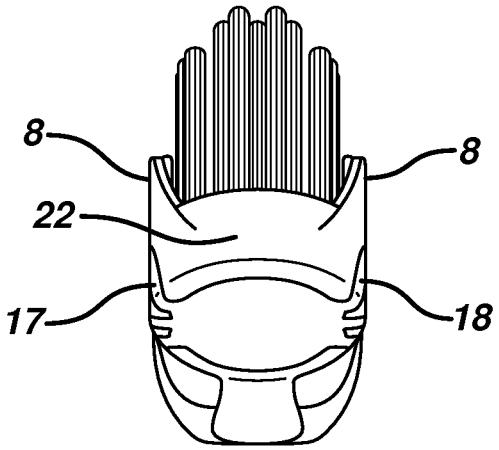
FIG. 4 is a front view of the toothbrush of FIG. 1 taken along the longitudinal axis of the base portion of the toothbrush.
Figure 5:
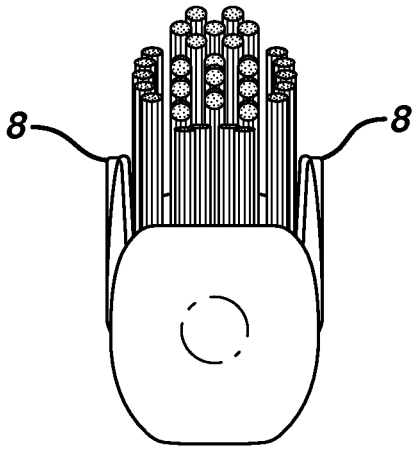
FIG. 5 is a rear view of the toothbrush of FIG. 1 taken along the longitudinal axis of the base portion of the toothbrush.

The toothbrush handle shown in FIG. 1 and FIG. 2 may be made from an injection molding machine from polypropylene. Ethylene propylene diene monomer was overmolded on the handle and the toothbrush head to form a thumb grip and gum cushions. Consumers found the toothbrush handle to be comfortable to use and liked the aesthetics of the toothbrush handle.

Example 2

Toothbrush Head

The toothbrush head of the toothbrush handle of Example 1 was filled with nylon toothbrush bristles in the pattern shown in FIG. 1 and FIG. 2. The angle of the toe tuft and the heel tuft was 83 degrees. The angle of the pairs of bristle tufts in the longitudinal direction of the toothbrush head was 83 degrees. The ends of the toothbrush bristles were trimmed to form peaks. The outer toothbrush bristles were tapered bristles. Consumers liked the aesthetics of the toothbrush head.

We claim:

1. A toothbrush, comprising:

a handle; and a toothbrush head including:

an end proximal the toothbrush handle;

an end distal to the toothbrush handle;

a dorsal surface holding a plurality of toothbrush bristles;

a ventral surface opposite the dorsal surface;

first and second sides disposed between the dorsal and ventral surfaces of the toothbrush head;

a first plurality of gum cushions disposed the first side of the toothbrush head; and a second plurality of gum cushions disposed on the second side of the toothbrush head;

wherein:

the height of each gum cushion relative to the height of the plurality of toothbrush bristles is less than the height of the plurality of toothbrush bristles; and first plurality of gum cushions is a configuration of multilobal cushions having at least two peaks with a valley therebetween, the bottom of the valley being higher than the dorsal surface of the toothbrush head, and the height of each of the peaks of the first plurality of gum cushions relative to the height of the plurality of toothbrush bristles tapers downward from the proximal end of the toothbrush head to the distal end of the toothbrush head such that the difference in height between the plurality of toothbrush bristles and a peak of the first plurality of gum cushions adjacent the distal end of the toothbrush head is greater than the difference in height between the plurality of toothbrush bristles and a peak of the first plurality of gum cushions adjacent the proximal end of the toothbrush head; and the second plurality of gum cushions is a configuration of multilobal cushions having at least two peaks with a valley therebetween, the bottom of the valley being higher than the dorsal surface of the toothbrush head, and the height of each of the peaks of the second plurality of gum cushions relative to the height of the plurality of toothbrush bristles tapers downward from the proximal end of the toothbrush head to the distal end of the toothbrush head such that the difference in height between the plurality of toothbrush bristles and a peak of the second plurality of gum cushions adjacent the distal end of the toothbrush head is greater than the difference in height between the plurality of toothbrush bristles and a peak of the second plurality of gum cushions adjacent the proximal end of the toothbrush head.

2. The toothbrush of claim 1 wherein the handle comprises an ovoid base portion for holding the handle in the hand of a consumer, a waist adjacent the base portion, a shoulder, a grip portion adjacent the waist and terminating at the shoulder, an offset adjacent the shoulder, and a neck adjacent the offset; wherein the waist and the grip portion are concave with respect to a dorsal surface of the base portion, an angle of a longitudinal axis bisecting the offset is from about 10 to about 45 degrees with respect to a longitudinal axis bisecting the base portion, an angle of a longitudinal axis bisecting the neck is from about 5 to about 15 degrees with respect to the longitudinal axis bisecting the base portion.

3. The toothbrush of claim 1, wherein the first plurality of gum cushions are formed of a soft and flexible material integrally molded in the configuration of multilobal cushions of the first plurality of gum cushions.

4. The toothbrush of claim 3, wherein the first plurality of gum cushions includes three peaks, with the respective heights of the peaks of the first plurality of gum cushions from the dorsal surface being about 8 mm, about 6.5 mm, and about 5 mm.

5. The toothbrush of claim 4, wherein the toothbrush head further comprises a toe tuft at an angle of less than 90 degrees towards the distal end of the toothbrush head.

6. The toothbrush of claim 5, wherein the toothbrush head further comprises a heel tuft at an angle of less than 90 degrees towards the proximal end of the toothbrush head.

7. The toothbrush head of claim 6, wherein the plurality of toothbrush bristles are trimmed to form angled peaks.

8. The toothbrush of claim 7, wherein the toe tuft is at an angle of about 83 degrees towards the distal end of the toothbrush head.

9. The toothbrush of claim 8, wherein the heel tuft is at an angle of about 83 degrees towards the proximal end of the toothbrush head.

10. The toothbrush of claim 1, wherein:

the first plurality of gum cushions includes at least three peaks with a valley between each of the at least three peaks;

the height of each of the valleys of the first plurality of gum cushions relative to the height of the plurality of toothbrush bristles tapers downward from the proximal end of the toothbrush head to the distal end of the toothbrush head such that the difference in height between the plurality of toothbrush bristles and a valley adjacent the peak of the first plurality of gum cushions that is adjacent the distal end of the toothbrush head is greater than the difference in height between the plurality of toothbrush bristles and a valley adjacent the peak of the first plurality of gum cushions that is adjacent the proximal end of the toothbrush head;

the second plurality of gum cushions includes at least three peaks with a valley between each of the at least three peaks; and the height of each of the valleys of the second plurality of gum cushions relative to the height of the plurality of toothbrush bristles tapers downward from the proximal end of the toothbrush head to the distal end of the toothbrush head such that the difference in height between the plurality of toothbrush bristles and a valley adjacent the peak of the second plurality of gum cushions that is adjacent the distal end of the toothbrush head is greater than the difference in height between the plurality of toothbrush bristles and a valley adjacent the peak of the second plurality of gum cushions that is adjacent the proximal end of the toothbrush head.

11. A toothbrush, comprising:

a handle; and a toothbrush head including:

an end proximal the toothbrush handle;

an end distal to the toothbrush handle;

a dorsal surface holding a plurality of toothbrush bristles;

a ventral surface opposite the dorsal surface;

first and second sides disposed between the dorsal and ventral surfaces of the toothbrush head;

a first plurality of gum cushions disposed on of the first side of the toothbrush head; and a second plurality of gum cushions disposed on the second side of the toothbrush head;

wherein:

the height of each gum cushion relative to the height of the plurality of toothbrush bristles is less than the height of the plurality of toothbrush bristles; and the first plurality of gum cushions is a configuration of multilobal cushions having at least two peaks with a valley therebetween, the bottom of the valley being higher than the dorsal surface of the toothbrush head, and the height of each of the of the first plurality of gum cushions relative to the dorsal surface tapers downward from the proximal end of the toothbrush head to the distal end of the toothbrush head such that a height of a peak of the first plurality of gum cushions adjacent the proximal end of the toothbrush head from the dorsal surface is greater than a height of a peak of the first plurality of gum cushions adjacent the distal end of the toothbrush head from the dorsal surface; and the second plurality of gum cushions is a configuration of multilobal cushions having at least two peaks with a valley therebetween, the bottom of the valley being higher than the dorsal surface of the toothbrush head, and the height of each of the peaks of the second plurality of gum cushions relative to the dorsal surface tapers downward from the proximal end of the toothbrush head to the distal end of the toothbrush head such that a height of a peak of the second plurality of gum cushions adjacent the proximal end of the toothbrush head from the dorsal surface is greater than a height of a peak of the second plurality of gum cushions adjacent the distal end of the toothbrush head from the dorsal surface.

12. The toothbrush of claim 11, wherein the first plurality of gum cushions includes three gum cushions having three peaks and two valleys on the first side of the toothbrush head, and the second plurality of gum cushions includes three gum cushions having three peaks and two valleys on the second side of the toothbrush head.

13. The toothbrush of claim 12, wherein the respective heights of the peaks of the first plurality of gum cushions from the dorsal surface are about 8 mm, about 6.5 mm, and about 5 mm.

14. The toothbrush of claim 13, wherein the toothbrush head further comprises a toe tuft at an angle of less than 90 degrees towards the distal end of the toothbrush head.

15. The toothbrush of claim 14, wherein the toothbrush head further comprises a heel tuft at an angle of less than 90 degrees towards the proximal end of the toothbrush head.

16. The toothbrush of claim 13, wherein the toothbrush head further comprises a toe tuft at an angle of about 83 degrees towards the distal end of the toothbrush head.

17. The toothbrush of claim 16, wherein the toothbrush head further comprises a heel tuft at an angle of about 83 degrees towards the proximal end of the toothbrush head.

18. The toothbrush of claim 11, further comprising pairs of toothbrush bristle tufts angled towards each other along the longitudinal direction of the toothbrush head at an angle of 83 degrees.

19. The toothbrush of claim 11, wherein the first plurality of gum cushions is in an integral configuration to provide the configuration of multilobal cushions of the first plurality of gum cushions.

20. The toothbrush of claim 11, wherein:

the first plurality of gum cushions includes at least three peaks with a valley between each of the at least three peaks;

the height of each of the valleys of the first plurality of gum cushions relative to the dorsal surface tapers downward from the proximal end of the toothbrush head to the distal end of the toothbrush head such that a height from the dorsal surface of a valley adjacent the peak of the first plurality of gum cushions that is adjacent the proximal end of the toothbrush head is less than a height from the dorsal surface of a valley adjacent the peak of the first plurality of gum cushions that is adjacent the distal end of the toothbrush head;

the second plurality of gum cushions includes at least three peaks with a valley between each of the at least three peaks; and the height of each of the valleys of the second plurality of gum cushions relative to the dorsal surface tapers downward from the proximal end of the toothbrush head to the distal end of the toothbrush head such that a height from the dorsal surface of a valley adjacent the peak of the second plurality of gum cushions that is adjacent the proximal end of the toothbrush head is less than a height from the dorsal surface of a valley adjacent the peak of the second plurality of gum cushions that is adjacent the distal end of the toothbrush head.

21. A toothbrush head, comprising:

an end proximal a toothbrush handle;

an end distal to the toothbrush handle;

a dorsal surface holding a plurality of toothbrush bristles;

a ventral surface opposite the dorsal surface;

first and second sides disposed between the dorsal and ventral surfaces of the toothbrush head;

a first plurality of gum cushions disposed on the first side of the toothbrush head;

a second plurality of gum cushions disposed on the second side of the toothbrush head; wherein:

first plurality of gum cushions is formed of a soft and flexible material molded in an integral configuration of multilobal cushions having at least two peaks with a valley therebetween, the bottom of the valley being higher than the dorsal surface of the toothbrush head;

the height of each of the peaks of the first plurality of gum cushions relative to the height of the plurality of toothbrush bristles tapers downward from the proximal end of the toothbrush head to the distal end of the toothbrush head such that a difference in height between the plurality of bristles and a peak of the first plurality of gum cushions adjacent the proximal end of the head is less than a difference in height between the plurality of bristles and a peak of the first plurality of gum cushions adjacent the distal end of the head;

the second plurality of gum cushions is formed of a soft and flexible material molded in an integral configuration of multilobal cushions having at least two peaks with a valley therebetween, the bottom of the valley being higher the dorsal surface of the toothbrush head;

the height of each of the peaks of the second plurality of gum cushions relative to the height of the plurality of toothbrush bristles tapers downward from the proximal end of the toothbrush head to the distal end of the toothbrush head such that a difference in height between the plurality of bristles and a peak of the second plurality of gum cushions adjacent the proximal end of the head is less than a difference in height between the plurality of bristles and a peak of the second plurality of gum cushions adjacent the distal end of the head.

22. The toothbrush head of claim 21, wherein:

the first plurality of gum cushions includes three peaks with a valley between each peak;

the bottom of each valley of the first plurality of gum cushions is higher than the dorsal surface of the toothbrush head; and the bottom of each valley of the first plurality of gum cushions in a direction from the proximal end of the toothbrush head to the distal end of the toothbrush head is progressively further away from the free ends of the plurality of toothbrush bristles.

23. The toothbrush head of claim 21, wherein the height of each peak of the first plurality of gum cushions relative to the height of the plurality of toothbrush bristles is less than the height of the plurality of toothbrush bristles.

* * * * *